US010040515B2

(12) United States Patent
Mellor

(10) Patent No.: US 10,040,515 B2
(45) Date of Patent: Aug. 7, 2018

(54) SUPPORT BUOY

(71) Applicant: Aquadownunder Pty Ltd, Applecross, Western Australia (AU)

(72) Inventor: Peter David Kingston Mellor, Applecross (AU)

(73) Assignee: Aquadownunder Pty Ltd, Applecross (AU)

( * ) Notice: Subject to any disclaimer, the term of this patent is extended or adjusted under 35 U.S.C. 154(b) by 0 days.

(21) Appl. No.: 15/321,103

(22) PCT Filed: Feb. 3, 2015

(86) PCT No.: PCT/AU2015/000056

§ 371 (c)(1),
(2) Date: Dec. 21, 2016

(87) PCT Pub. No.: WO2015/196234

PCT Pub. Date: Dec. 30, 2015

(65) Prior Publication Data

US 2017/0129572 A1 May 11, 2017

(30) Foreign Application Priority Data

Jun. 26, 2014 (AU) ..... 2014902447

(51) Int. Cl.

| | |
|---|---|
| ***B63B 22/24*** | (2006.01) |
| ***B63G 8/24*** | (2006.01) |
| ***B63G 8/00*** | (2006.01) |

(52) U.S. Cl.

CPC ..... *B63B 22/24* (2013.01); *B63G 8/001* (2013.01); *B63G 8/24* (2013.01); *B63G 2008/007* (2013.01); *B63G 2008/008* (2013.01)

(58) Field of Classification Search

CPC ..... B63G 8/001; B63G 8/24; B63B 22/24
See application file for complete search history.

(56) References Cited

U.S. PATENT DOCUMENTS

| | | | |
|---|---|---|---|
| 6,536,528 | B1 | 3/2003 | Amin et al. |
| 6,782,950 | B2 | 8/2004 | Amin et al. |
| 8,251,003 | B2 * | 8/2012 | Vandenworm ..... B63B 1/041 114/230.2 |
| 2010/0025043 | A1 | 2/2010 | Ingebrigtsen et al. |
| 2010/0025996 | A1 | 2/2010 | Edwards et al. |
| 2012/0304911 | A1 | 12/2012 | McCoy |

OTHER PUBLICATIONS

International Search Report for PCT/AU2015/000056, ISA/AU, Woden ACT, dated Apr. 15, 2015.
First Written Opinion of the ISA for PCT/AU2015/000056, ISA/AU, Woden ACT, dated Apr. 15, 2015.
Second Written Opinion for PCT/AU2015/000056, ISA/IPEA/AU, Woden ACT, dated Nov. 9, 2015.
International Preliminary Report on Patentability (Ch. II) with annexes for PCT/AU2015/000056, IPEA/AU, dated Oct. 28, 2016.

* cited by examiner

*Primary Examiner* — Stephen P Avila
(74) *Attorney, Agent, or Firm* — Harness, Dickey & Pierce, P.L.C.

(57) ABSTRACT

A support buoy for supporting subsea equipment, the buoy comprising:
a hull;
a generator unit contained within the hull;
a utilities array contained within the hull; and
an umbilical,
wherein the umbilical is adapted to provide services from the generator unit and the utilities array to the subsea equipment.

29 Claims, 3 Drawing Sheets

SUPPORT BUOY

CROSS-REFERENCE TO RELATED APPLICATIONS

This application is a 371 U.S. National Stage of International Application No. PCT/AU2015/000056, filed Feb. 3, 2015. This application claims the benefit of Australian Patent Application No. 2014902447, filed Jun. 26, 2014. The disclosures of the above applications are incorporated herein by reference.

TECHNICAL FIELD

The present invention relates to a support buoy. More specifically, the support buoy of the present invention is intended for use in supplying power and other services to support subsea equipment.

BACKGROUND ART

The following discussion of the background art is intended to facilitate an understanding of the present invention only. The discussion is not an acknowledgement or admission that any of the material referred to is or was part of the common general knowledge as at the priority date of the application.

Industrial enterprises, scientific associations, and government organisations need to collect marine data relating to a variety of tasks and undertakings. Such data is essential to the successful conduct of operations in the digital oilfield, coastal security, and safety or at-risk environmental areas. This data often needs to be collected from remote, isolated offshore areas. The collector of this data typically requires the use of subsea imaging or other data collecting equipment that is not itself self-sufficient and requires an entire ship based support crew in order to deploy, power, and run the equipment. This becomes a very expensive exercise, especially when the subsea equipment needs to be deployed for extended periods of time. Additionally, in particular conditions the deployment of such equipment in offshore locations becomes dangerous. It is against this background that the present invention has been developed.

The present invention seeks to overcome, or at least ameliorate, one or more of the deficiencies of the prior art mentioned above, or to provide the consumer with a useful or commercial choice.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness.

SUMMARY OF INVENTION

In accordance with the present invention there is provided a support buoy for supporting subsea equipment, the buoy comprising:

a hull;

a generator unit contained within the hull;

a utilities array contained within the hull;

one or more accelerometers; and an umbilical, wherein the umbilical is adapted to provide services from the generator unit and the utilities array to the subsea equipment and wherein the one or more accelerometers are provided in a feedback loop with the generator unit such that once motion above a certain threshold is measured, the generator unit is disabled.

The buoy of the present invention is intended to be suitable for deployment in remote offshore locations in order to provide utility services to subsea equipment. The buoy is intended to be capable of providing such services for an extended period of time, without the need for physical intervention.

Preferably, the generator unit is capable of supplying of electricity services to the subsea equipment. Preferably, the generator unit comprises a fuel powered generator.

In a preferred form of the present invention, the utilities array comprises a battery bank. Preferably, the battery bank is charged during operation of the generator. The battery bank of the present invention is adapted to provide power to the utilities array at times when the generator unit is not operating. In this manner, the buoy of the present invention is able to conserve fuel stored on the support buoy.

Preferably, the buoy of the present invention further comprises a fuel tank to provide a fuel source for the generator unit. Still preferably, the fuel tank is contained with the hull.

In one form of the present invention the utilities array of the present invention is able to be controlled remotely. Preferably, remote operation of the utilities array allows for the remote operation and retrieval of data from the subsea equipment.

In a further form of the present invention, the utilities array further comprises one or more programmable logic controllers (PLCs). Preferably, the one or more PLCs are adapted to control one or more functions of the utilities array. Still preferably, the PLCs are adapted to turn on and off the generator unit, in order to operate the subsea equipment at specific time intervals.

In one form of the present invention, the buoy of the present invention may further be fitted with additional sensors for one or more data recording devices.

Preferably, the buoy further comprises a transmission array. The transmission array preferably supports telecommunications and data transmission to and from the buoy.

In a further embodiment of the present invention, the buoy further comprises one or more accelerometers. Preferably, the one or more accelerometers are provided in a feedback loop with the generator unit such that once motion above a certain threshold is measured, the generator is disabled. Through the inclusion of the one or more accelerometers, the buoy of the present invention is adapted to disable operation of the generator unit during storms or other rough offshore conditions. In the manner, the generator unit is protected from any damage that may occur during operation in such conditions.

In a further embodiment of the present invention, the hull is provided in two separate components, an outer portion and an inner portion. Preferably, the outer portion is of a greater diameter than the inner portion. Still preferably, the outer portion surrounds substantially the inner portion, supporting the inner portion therein.

Preferably, the outer portion is foam filled to aid flotation.

Preferably, the inner portion houses the utilities array.

In a further embodiment of the present invention, the buoy is adapted such that the outer portion remains outside the body water in which the buoy is deployed.

In one form of the present invention, the umbilical is provided as a hybrid cable for electricity and fiber optic transfer. Preferably, the umbilical is capable of deploying and retrieving the subsea equipment.

Preferably, the umbilical has a controlled break point, such that under sufficient force the umbilical with detach from the buoy.

In accordance with a further embodiment of the present invention, there is provided a method for the operation of subsea equipment, comprising the steps of:

i. deploying a support buoy having a generator unit and a utilities array contained therein;
ii. mooring the buoy is a position close to the subsea equipment;
iii. linking the buoy and the subsea equipment by way of an umbilical; and
iv. operating the subsea equipment by way of the generator unit and the utilities array.

Preferably, the generator unit is capable of supplying electricity services to the subsea equipment. Preferably, the generator unit is fuel powered. Still preferably, the generator unit sources fuel from a fuel tank contained within the buoy.

Preferably, operation of the utilities array is possible by remote. Preferably, remote operation of the utilities array allows for retrieval of data from the subsea equipment.

In one form of the present invention, the utilities array further comprises one or more PLCs. Preferably, the one or more PLCs are adapted to control various function of the utilities array. Still preferably, the PLCs are adapted to turn off the generator unit, in order to operate the subsea equipment at specific time intervals.

Preferably, data is sent and received by the buoy by way of a transmissions array located on the buoy.

In a further embodiment of the present invention, the buoy further comprises one or more accelerometers. Preferably, the one or more accelerometers are provided in a feedback loop with the generator unit such that once motion above a certain threshold is measured, the generator unit is disabled.

In one form of the present invention, the umbilical provides fiber optics and electricity to the subsea equipment and telemetry that may be assessed remotely.

In a further embodiment of the present invention the umbilical can be disconnected and dropped to the seafloor. In this manner, the buoy can be relocated to other subsea equipment as required.

In one form of the present invention, the buoy is moored to a buoy mooring. Preferably, the buoy mooring is anchored to a subsea surface in a four point anchor arrangement. In such arrangement, four anchor points are provide on the subsea surface, each linking up to a respective anchor point on the buoy.

In a further form of the present invention the buoy is tethered to the buoy mooring by way of mooring attachment points provided on the hull. Preferably, the mooring attachment points are provided at opposing sides of the hull.

Throughout this specification, unless the context requires otherwise, the word "comprise" or variations such as "comprises" or "comprising", will be understood to imply the inclusion of a stated integer or group of integers but not the exclusion of any other integer or group of integers. The term "services" or variations thereof is to be understood to include power, communication and other data or information transfer mechanisms.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
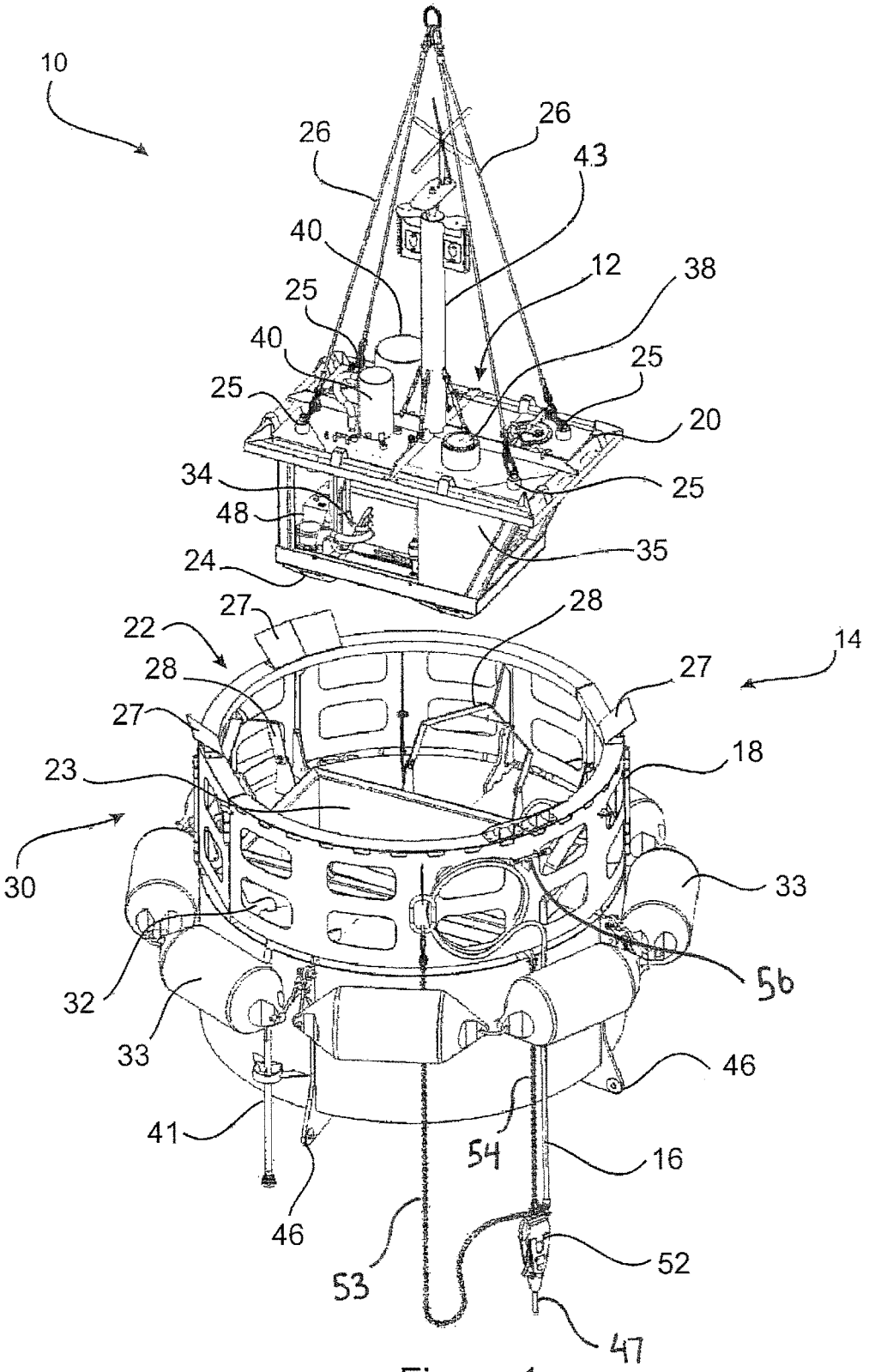
FIG. 1 is a upper perspective view of a support buoy in accordance with the present invention.
Figure 2:
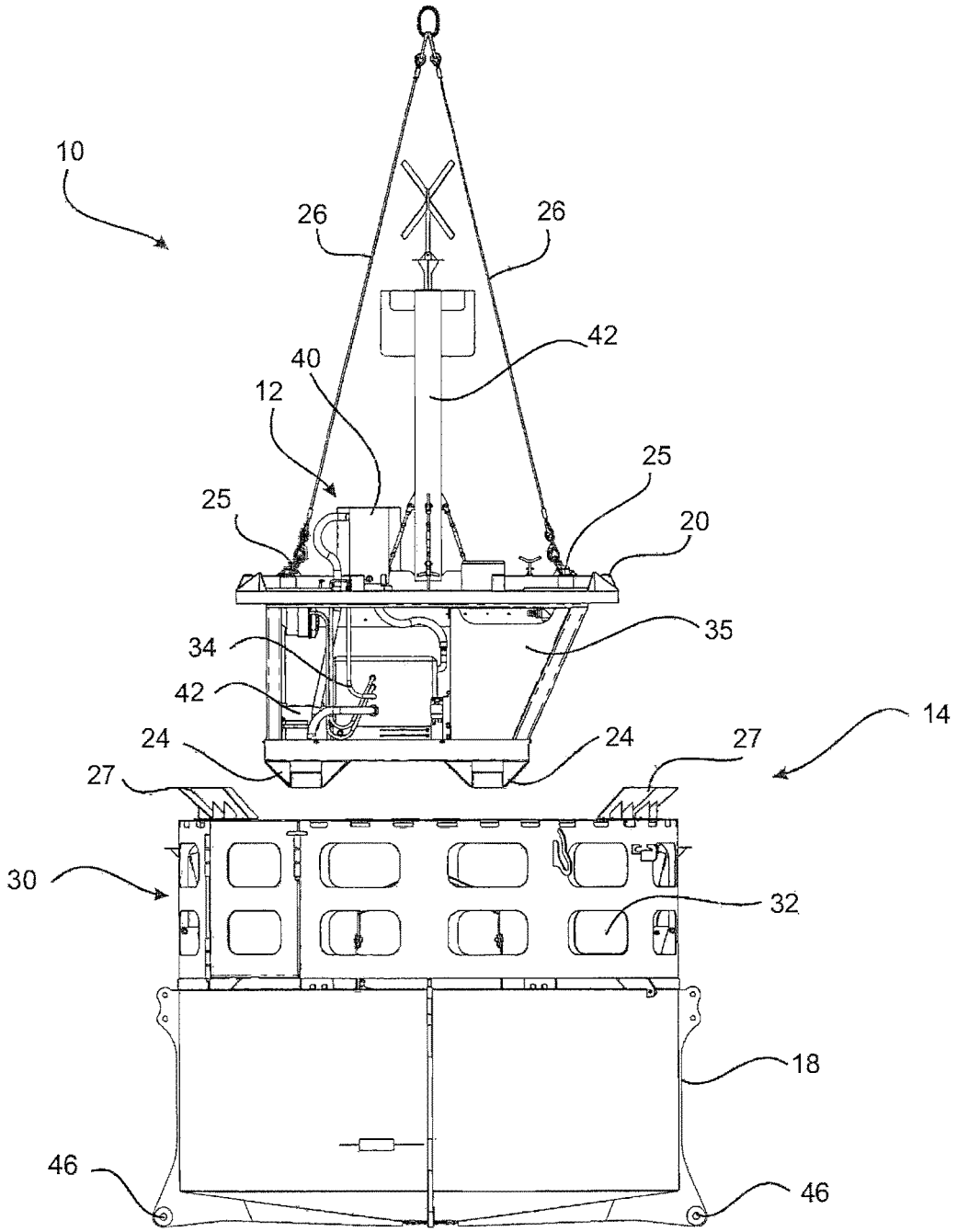
FIG. 2 is a plan view of the support buoy of FIG. 1.
Figure 3:
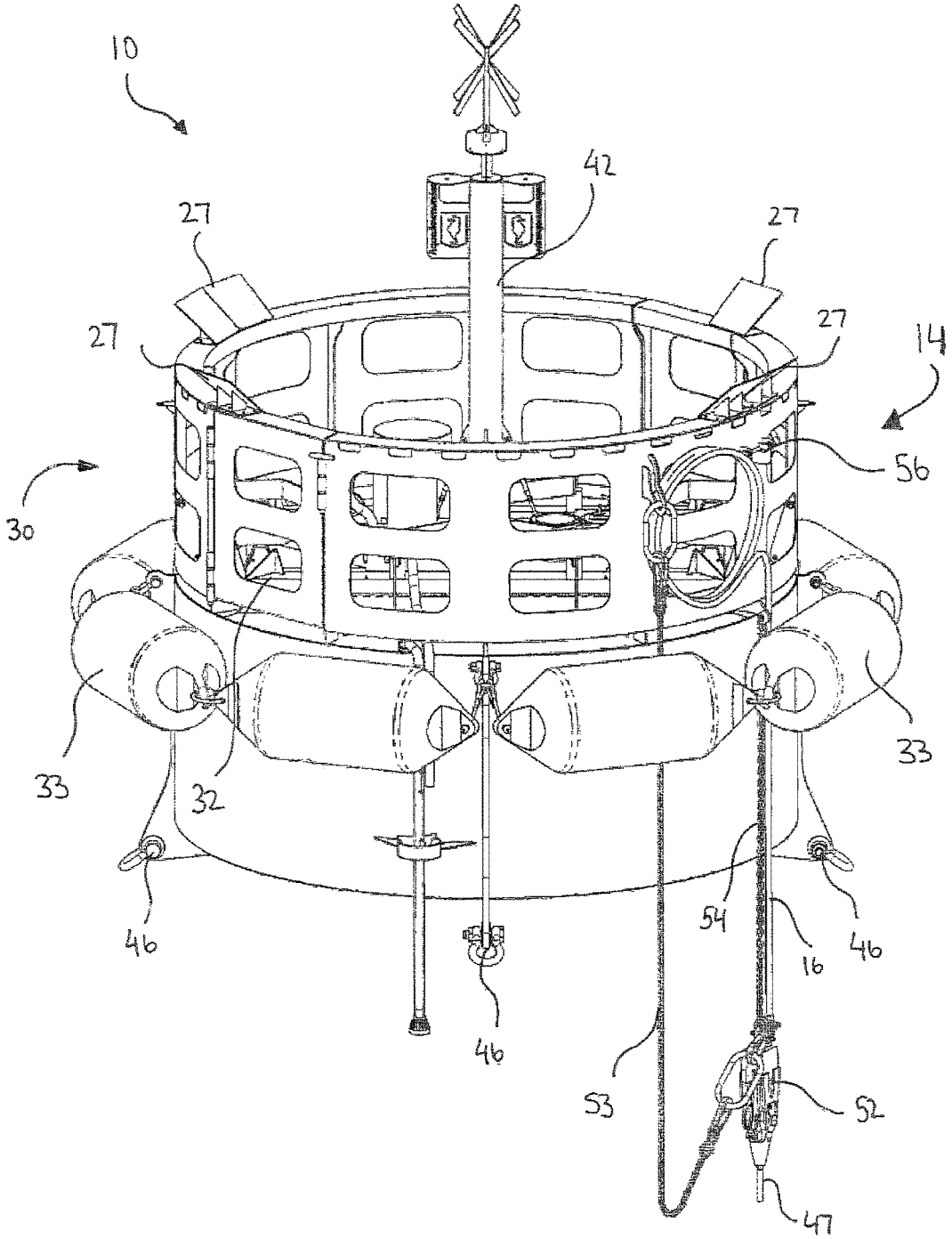
FIG. 3 is an upper perspective view of the support buoy of FIG. 1 in a fully assembled form.

In FIGS. 1 to 3, there is shown a support buoy 10 for supporting subsea equipment (not shown). The buoy 10 comprises a utilities array 12 contained within a hull 14. The utilities array 12 is adapted to provide power and communication services between the subsea equipment and the buoy 10. These services are provided by way of an umbilical 16 which is adapted to transfer such services.

The hull 14 is provided in two separate components, an outer portion 18 and an inner portion 20. The outer portion 18 is of a greater diameter than the inner portion 20. As can be best seen in FIG. 1, the outer portion 18 is substantially cylindrical in shape with a hollow interior section 22. The interior has provided therein a cavity 23, adapted to receive the inner portion therein, such that the inner portion is substantially contained within the outer portion 18, and the outer portion 18 fully surrounds the inner portion 20. Preferably the outer portion is filled with foam to aid flotation. An underside of the inner portion 20 is provided with a series of bunds 24 to protect the inner portion 20 from impact when being lowered.

The inner portion 20 is lowered into the outer portion, typically by way of a crane, and positioned into the cavity 23. A series of anchor points 25 are provided on a top side of the inner portion 18 to allow for the attachments of cables 26 which may be attached to a crane (not shown). A series of guidance plates 27 are provided around a perimeter of the outer portion 18. These guidance plates 27 are arranged such that the inner portion 18 is guided towards the cavity 23 whilst it is lowered into position. Once the inner portion 18 is fitted into the outer portion 20, it is retained in that position by a series locking arms 28 which fold towards the inner portion 20 to secure its position. Additionally, when the locking arms 28 are in an open position, they further act to guide the inner portion 18 towards the cavity 23 as the inner portion 18 is lowered into the outer portion 20.

An upper end 30 of the outer portion 18 is constructed of a light weight material and further comprises a number of apertures 32. In the event of impact upon the buoy 10, the upper end 30 will deform in order to absorb the energy of the impact, thereby reducing the shock of the impact on the remainder of the buoy. Additionally, a series of pneumatic fenders 33 are provided around the circumference of the outer portion 20 to further protect the buoy 10 from impacts. The utilities array 12 is contained wholly within the inner portion 20.

The buoy 10 comprises generator unit 34 contained within the hull 14. The generator unit 34 is a fuel powered generator capable of providing between 120V and 240V at continuous power. Importantly, the generator unit 34 is capable of being operated at up to a 30 degree incline in order to cope with the rocking of the buoy 10 when deployed.

Fuel for the generator unit 34 is stored in a fuel reservoir 35 which is contained within the inner portion 20. The fuel reservoir 35 will typically have a capacity of 250 L and is triple bunded in order to prevent leakage. The fuel reservoir 35 may be refuelled through a refuelling point 38 located on the upper side of the inner portion 20. This allows the buoy 10 to be refuelled without having to remove the inner portion 20, allowing the refuelling process to be completed whilst the buoy 10 is deployed. An air intake and exhaust of the generator unit 34 are provided by way of water lock intake and exhaust canisters 40, which are located on the upper side of the inner portion 20. The canisters 40 provide an air trap, allowing the buoy to be submerged and be operational once it surfaces. These also prevent water getting into the generator unit 34 during storms or other rough weather conditions. Cooling for the generator unit 34 is provided through a water pickup 41 which located on the exterior of the outer portion 18. Operation of the generator unit 34 is controlled by a number of PLC's (not shown) located within the utilities array 12.

The utilities array 12 further comprises a battery bank 42, which is charged during operation of the generator unit 34. The battery bank allows for the operation of the certain features of the utilities array 12, without the need for the generator unit 34 to be operating.

The utilities array 12 is also fitted with additional sensors and data recording devices (not shown). These sensors include accelerometers to measure the metocean conditions and movement of the buoy 10 during operations. These sensors operate in a feedback loop with the PLC's in order to prevent operation of the generator unit during rough ocean conditions. There also may be included sensors associated with the generator unit 34, to detect the temperature and the fuel status thereof. Data recording devices in the utilities array are capable of not only recording data provided by the on board sensors, but are also adapted to record data recorded by the subsea equipment.

The utilities array 12 further comprises a transmissions array (not shown) which supports telecommunications and data transmission to and from the buoy 10. The buoy 10 supports wireless (Wi-Fi), mobile (3G, 4G) and satellite data transmission. An antenna 43 is provided on an upper surface of the inner portion 20 to support the data transmission of the transmission array. The transmission array allows for data from the buoy 10 and the subsea equipment to be downloaded remotely from anywhere in the world. It also allows for remote control of the generator unit 34 and subsea equipment.

The buoy 10 further comprises mooring attachment points 46. The buoy 10 utilises an established buoy mooring (not shown) to retain the buoy 10 in a desired location. The buoy mooring is anchored to a subsea surface in a four point anchor arrangement. The buoy 10 is tethered to the mooring by way of the mooring attachments points 46. By utilising a 3 or 4 point attachment arrangement, the buoy 10 is prevented from twisting more than 1 degree per meter. Four anchors (not shown) are provided in a square arrangement 100 meters apart on the subsea floor beneath the buoy 10 and are tethered by chains to the mooring attachments points 46.

The umbilical 16 is connected to the utilities array 12 by way of a breakout box (not shown). If force is applied to the umbilical 16, the breakout box disconnects from the utilities array 12 thereby disconnecting the umbilical 16 from the utilities array 12 without causing damage.

The umbilical 16 comprises one or more hybrid cables for both electricity fibre optics communications. The umbilical 16 further has triple armouring 47 with a large breaking load (for example approximately 440 kN) to protect the umbilical and allow for the retrieval and deployment of the subsea equipment. The umbilical 16 is adapted to be disconnected from the buoy 10 without affecting the seal of the hull 14. It is envisaged that the umbilical 16 may be disconnected and dropped to the sea floor to allow the buoy 10 to be temporarily moved to another location.

As best shown in FIGS. 1 and 3, the umbilical 16 is fed through an umbilical strain terminator 52, which progressively removes the triple armouring 47 from the umbilical 16 to expose the one or more hybrid cables. The umbilical strain terminator 52 also provides an anchoring point to allow the deployment of the umbilical 16. A deployment chain 53 attaches to the umbilical strain terminator 52 which can then be in turn attached to a crane, or other winch, to lift the umbilical 16. Also attached to the umbilical strain terminator 52 is a break point chain 54. If the strain on the umbilical 16 is too high, for example during a storm or in the event of a watercraft collision, the break point chain 54 will break, triggering the disconnection of the umbilical strain terminator 52 from the buoy 10 The umbilical is fed through a cutting point 56, such that if the umbilical strain terminator 52 is detached form the buoy 10, then the strain applied on the umbilical 16 will cause the cutting of the umbilical 16 at the cutting point 56.

Advantageously, the buoy 10 of the present invention is able to provide support services to subsea equipment located in offshore locations. This allows for the subsea equipment to be operated without the need of a support ship and crew to be on location for an extended period of time. Particularly, this allows for the subsea equipment to collect data for a far greater period of time. The utilities array 12 can also be arranged such that the generator unit 34 may be started automatically at set intervals. Additionally, by being able to drop the umbilical 16, the buoy 10 of the present invention can be moved from one piece of subsea equipment to another without the need to retrieve the first piece of equipment.

Due to its design, the buoy 10 can withstand impacts and can withstand cyclones with the ability to be submerged for short periods. With the inclusion of the inbuilt accelerometers, the generator unit 34 will automatically stop operation if rough conditions are experienced by the buoy 10. In the event that the buoy 10 becomes caught up in a vessel, the umbilical 16 has a controlled break point, meaning that the buoy 10 will not be dragged with the vessel.

Those skilled in the art will appreciate that the invention described herein is susceptible to variations and modifications other than those specifically described. The invention includes all such variation and modifications. The invention also includes all of the steps, features, formulations and compounds referred to or indicated in the specification, individually or collectively and any and all combinations or any two or more of the steps or features.

The invention claimed is:

1. A support buoy for supporting subsea equipment, the buoy comprising:

a hull;

a generator unit contained within the hull;

a utilities array contained within the hull;

one or more accelerometers; and an umbilical, wherein the umbilical is adapted to provide services from the generator unit and the utilities array to the subsea equipment and wherein the one or more accelerometers are provided in a feedback loop with the generator unit such that once motion above a threshold is measured the generator unit is disabled.

2. The support buoy according to claim 1, wherein the generator unit is capable of supplying of electricity services to the subsea equipment.

3. The support buoy according to claim 2, wherein the generator unit comprises a fuel powered generator.

4. The support buoy accordingly to claim 1, wherein the utilities array further comprises a battery bank.

5. The support buoy according to claim 4, wherein the battery bank is charged during operation of the generator.

6. The support buoy according to claim 4, wherein the battery bank of the present invention is adapted to provide power to the utilities array at times when the generator unit is not operating.

7. The support buoy according to claim 1, wherein the support buoy further comprises a fuel tank to provide a fuel source for the generator unit.

8. The support buoy according to claim 7, wherein the fuel tank is contained with the hull.

9. The support buoy according to claim 1, wherein the utilities array is controlled remotely.

10. The support buoy according to claim 9, wherein remote operation of the utilities array allows for the remote operation and retrieval of data from the subsea equipment.

11. The support buoy according to claim 1, wherein the utilities array further comprises one or more programmable logic controllers (PLCs).

12. The support buoy according to claim 11, wherein the one or more PLCs are adapted to control one or more functions of the utilities array.

13. The support buoy according to claim 11, wherein the PLCs are adapted to turn on and off the generator unit, in order to operate the subsea equipment at specific time intervals.

14. The support buoy according to claim 1, wherein the buoy further comprises additional sensors for one or more data recording devices.

15. The support buoy according to claim 1, wherein the buoy further comprises a transmission array.

16. The support buoy according to claim 15, wherein the transmission array supports telecommunications and data transmission to and from the buoy.

17. The support buoy according to claim 1, wherein the buoy further comprises one or more accelerometers.

18. The support buoy according to claim 17, wherein the one or more accelerometers are provided in a feedback loop with the generator unit such that once motion above a certain threshold is measured, the generator is disabled.

19. The support buoy according to claim 1, wherein the hull is provided in two separate components, being an outer portion and an inner portion.

20. The support buoy according to claim 19, wherein the outer portion surrounds substantially the inner portion, supporting the inner portion therein.

21. The support buoy according to claim 19, wherein the inner portion houses the utilities array and any additional supporting components.

22. The support buoy according to claim 1, wherein the umbilical is provided as a hybrid cable for electricity and fiber optic transfer.

23. A method for the operation of subsea equipment, comprising the steps of:

a. deploying a support buoy having a generator unit and a utilities array and one or more accelerometers contained therein;

b. mooring the buoy is a position close to the subsea equipment;

c. linking the buoy and the subsea equipment by way of an umbilical; and d. operating the subsea equipment by way of the generator unit and the utilities array, wherein the one or more accelerometers are provided in a feedback loop with the generator unit such that once motion above a threshold is measured the generator unit is disabled.

24. The method for the operation of subsea equipment according to claim 23, wherein the operation of the utilities array is possible remotely.

25. The method for the operation of subsea equipment according to claim 23, wherein remote operation of the utilities array allows for retrieval of data from the subsea equipment.

26. The method for the operation of subsea equipment according to claim 23, wherein the umbilical can be disconnected.

27. The method for the operation of subsea equipment according to claim 23, wherein the buoy is moored to a buoy mooring.

28. The method for the operation of subsea equipment according to claim 27, wherein the buoy mooring is anchored to a subsea surface in a four point anchor arrangement.

29. The method for the operation of subsea equipment according to claim 28, wherein the buoy is anchored to the buoy mooring by way of attachment points provided at opposing sides of the buoy.

* * * * *